United States Patent [19]

Westberg

[11] Patent Number: 4,621,787

[45] Date of Patent: Nov. 11, 1986

[54] PRESTRESSABLE PASSAGE CORE

[75] Inventor: Knut S. Westberg, Mt. Pleasant, Australia

[73] Assignee: A-Betong AB, Sweden

[21] Appl. No.: 606,748

[22] Filed: May 3, 1984

[30] Foreign Application Priority Data

May 6, 1983 [SE] Sweden ..... 8302598

[51] Int. Cl.[4] ..... B28B 7/30

[52] U.S. Cl. ..... 249/63; 249/66 R; 249/153; 249/179; 425/438; 425/440

[58] Field of Search ..... 249/144, 152, 153, 178, 249/179, 183, 63, 11, 66 R; 264/228; 425/111, 438, 440

[56] References Cited

U.S. PATENT DOCUMENTS

| | | | |
|---|---|---|---|
| 2,029,147 | 1/1936 | Anderson | 249/183 |
| 2,234,784 | 3/1941 | Stolz | 249/183 |
| 2,968,855 | 1/1961 | Stolz | 249/183 |
| 3,260,494 | 7/1966 | Deigaard | 249/63 |
| 3,464,173 | 9/1969 | Ros | 264/228 |
| 3,583,047 | 6/1971 | Uchiyama | 264/228 |
| 4,316,595 | 2/1982 | Wheeler et al. | 264/228 |

FOREIGN PATENT DOCUMENTS 33688 3/1911 Sweden .

*Primary Examiner*—Jay H. Woo
*Assistant Examiner*—James C. Housel
*Attorney, Agent, or Firm*—Robert J. Koch

[57] ABSTRACT

In a method of using an elongate steel core for making passages in a body of castable material, preferably concrete which is cast in an outer mould, the core is prestressed prior to casting, and to disengage the core from the finished body, the prestress is relieved against the body or the outer mould when the material has set sufficiently. The core is provided at its ends with anchoring means for one or more tensioning members extending therebetween for prestressing the core prior to casting, the prestress for disengaging the core from the finished body being relievable against said body or said outer mould by means of an abutment engageable therewith.

4 Claims, 6 Drawing Figures

Adhesion stress on surface area at different times

PRESTRESSABLE PASSAGE CORE

The present invention relates to a method of using an elongate, reusable core for providing passages in a body of castable material, preferably concrete which is cast in an outer mould. The core is intended to be withdrawn from the body when the castable material has set sufficiently to permit removal of the core.

Passages have previously been constructed by means of passage cores which have been dimensioned for the requisite withdrawal forces. On withdrawal, these forces have been applied to one end of the core. In some cases, the core has been made shrinkable to facilitate withdrawal. This could be done in several different ways, for example by means of a core covered with an inflatable rubber jacket, a slit core that can be contracted etc.

If the core and the body of castable material have large surface areas and a considerable adhesive capacity which is not readily eliminated by means of lubricants, the withdrawal forces will be of such magnitude that manufacture of the core will be highly expensive, and at the worst the core will not have sufficient strength to take up the expected loads. As has been mentioned above, the solution may then lie in a shrinkable core, and this normally means a very high investment of capital and an extremely expensive construction on the whole.

The present invention aims at making it possible to detach cores of very large surface area requiring very large withdrawal forces which must exceed the adhesive forces between the core and the castable material. Furthermore, the present invention aims at providing a core capable of withstanding large withdrawal forces.

These and other objects of the invention are achieved in that the core is prestressed prior to casting, and that the prestress is relieved against the body or outer mould to disengage the core from the finished body when the material has set sufficiently. In this manner, the core is readily disengaged from the finished body and can then be readily withdrawn therefrom.

The invention also relates to the construction of the core proper which is elongate and may have cylindrical or slightly conical shape. This core is characterised in that it is provided at its ends with anchoring means for one or more tensioning members extending therebetween for prestressing the core prior to casting, and in that, for disengaging the core from the finished body, the prestress is relievable against said body or the outer mould by means of an abutment engageable therewith.

The invention will be described in more detail below, reference being had to the accompanying drawings which illustrate the manufacture of a concrete pillar having a central cavity provided by means of a core according to the present invention, and in which.

Figure 1:
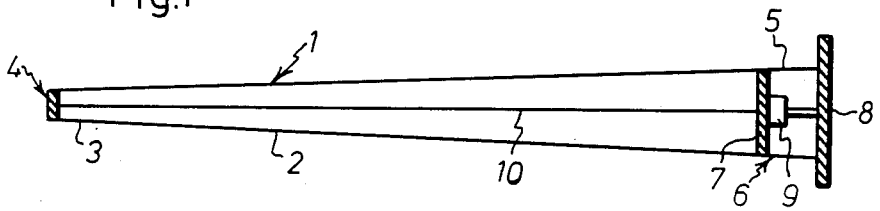
FIG. 1 is a schematic longitudinal section of the core in the unloaded state, i.e. before it is prestressed.

In the drawings, the core generally designated 1 has a steel jacket 2 and may be of optional length. The core preferably is of circular cross-section, although other cross-sectional shapes are also possible. As will appear from the drawings, the core has a conical shape, although the conicity has been slightly exaggerated for purposes of illustration. At its minor end 3, the core is provided with a passive anchoring means 4 in the form of a stationary anchor plate, while the major end has an active anchoring means 6 consisting of a stationary anchor plate 7 and an abutment 8 movable longitudinally of the core 1, the stationary anchor plate 7 and the movable abutment 8 being positively interconnected by means of a jack unit 9. Between said anchoring means 4 and 6, one or more tensioning members 10 extend which preferably are in the form of plastic-coated steel cables, rods or the like. In the drawings, only one such tensioning member 10 is shown, but several such members may be positioned symmetrically about the centre line of the core 1. As will appear from the drawings, the passive anchoring means 4 at the minor end 3 may be positioned at the extreme end of the core 1 or at a distance from the minor end 3 of said core, whereby the part of the core between the anchoring means 4 and the minor end 3 of the core 1 will not be subjected to prestressing forces. The jack unit 9 has been shown schematically only and may, in actual practice, comprise one or more jacks to establish a stable movement of the movable abutment 8.

Figure 2:
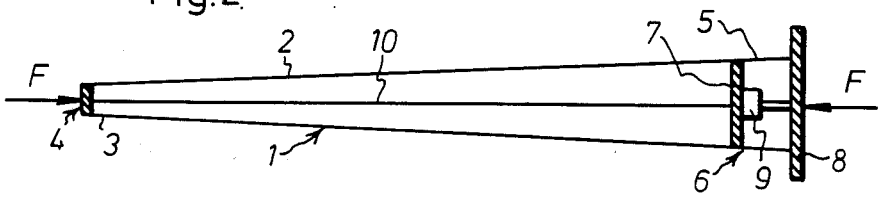
FIG. 2 is a section corresponding to FIG. 1 and showing the core in its prestressed or normal state.
Figure 3:
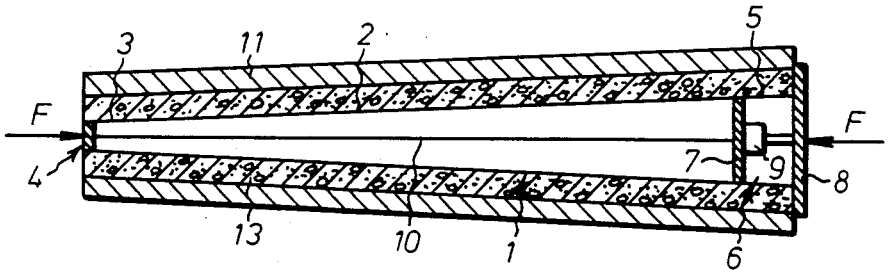
FIG. 3 is a section corresponding to FIGS. 1 and 2 and showing a finished concrete pillar in which the core has made a central cavity within the pillar.

FIG. 2 shows the core 1 in the prestressed state, the prestress being established by means of an outer jack unit or the like (not shown). The jack unit 9 is still inoperative, and the tensioning members 10 are clamped against the anchoring means 4 of the minor end 3 and against the movable abutment 8 at the major end 5 and are anchored therein in some suitable manner.

The core 1 is positioned in an outer mould 11, and castable material, preferably concrete, is poured into the space between the outer mould 11 and the core 1, the core thus providing a cavity or a passage 12 (FIG. 5) in the body 13 which has been cast from the castable material. In the drawings, the body 13 is a concrete pillar for power lines or the like.

Figure 4:
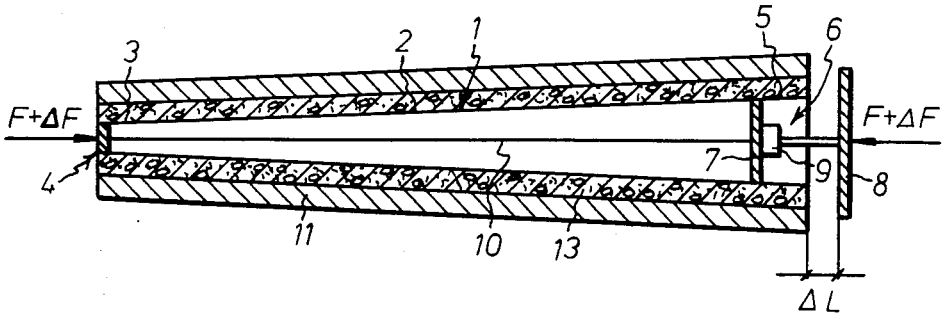
FIGS. 4 and 5 illustrate schematically and in longitudinal section the method according to the invention on disengagement and withdrawal of the core.
Figure 5:
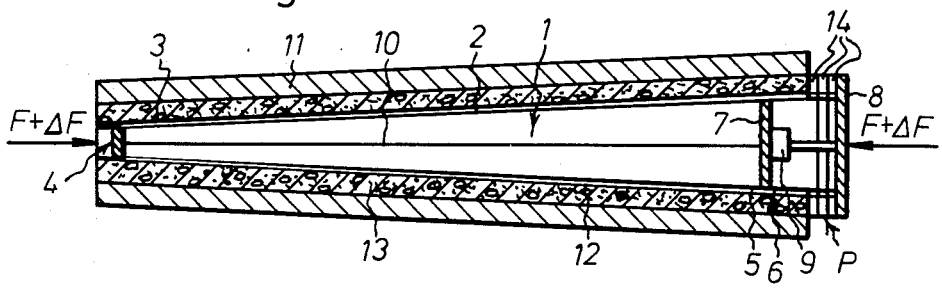

FIGS. 4 and 5 illustrate the withdrawal or disengagement of the core 1 from the finished body 13. In FIG. 4 the movable abutment 8 has been pushed out by means of the jack unit 9 within the core 1. If the core 1 is long, this pushing motion requires a very moderate additional force in the tensioning members 10 over and above the previously applied force F. The additional force is designated $\Delta F$ and, thus, gives the push $\Delta L$. The movable abutment 8 is then blocked up against the end of the outer mould 11 or directly against the end of the body 13 via the spacers 14 shown in FIG. 5. The force in the jack unit 9 is then reduced, and the tensioning force $F+\Delta F$ is transferred from the core 1 to the body 13, as a result of which the core 1 will "creep" out of the body 13.

Figure 6:
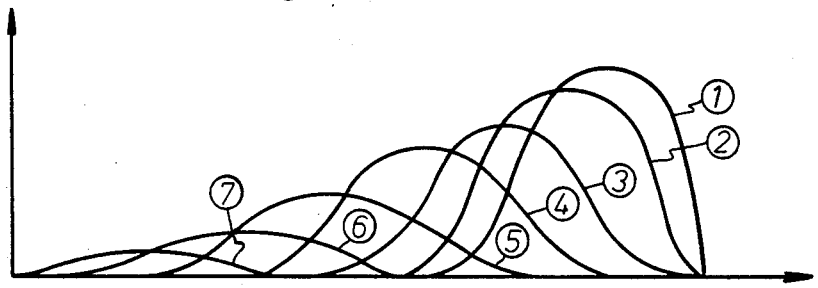
FIG. 6 is a diagram showing a series of curves of the magnitude in distribution of the adhesion stresses along the length of the pillar/core as a function of the time and illustrating the play of the forces between the circumference of the core and the inner wall of the concrete pillar.

The play of the forces between the jacket 2 of the core 1 and the inner wall of the finished body 13 is illustrated in FIG. 6 by means of a series of curves showing the magnitude and distribution of the adhesion stresses along the length of the body/core. Curve 1 indicates the play of forces at the time 0 when the force P (FIG. 5) between the movable abutment 8 and the body 13/the outer mould 11 has produced no "creeping-out" of the core 1. When P reaches a value at which the adhesion stresses exceed the breaking stresses in the joint between the body 13 and the core 1, the core begins to creep out. The progressively numbered curves illustrate the course of events as a function of the time. The final result is that the core 1 creeps out of the body 13. Because of the conical shape of the core 1, a comparatively small creeping out is necessary to make the requisite withdrawal force decrease to normal frictional force between the core 1 and the body 13, as is shown in FIG. 5.

The above-mentioned prestressing technique makes it possible to activate the core 1 with very large withdrawal forces, without subjecting the core to any resulting pull, and this in turn makes it possible to design larger cores without expensive special solutions necessitating shrinking movements of the section etc.

Another advantage of the present invention is that the core 1 is slightly expanded upon prestressing and thus reduces its diameter when the prestress is relieved.

A further advantage is that the prestress applied to the entire core 1 can be reduced at 0 at the major end 5 without necessitating dismantling of the tensioning members 10. This is accomplished by the different deformation characteristics in the tensioning members 10 and the core 1 and the body 13/the mould, respectively.

The method according to the invention eliminates the need for screwed joints in a divided core, and during handling the core 1 is held together by the prestressing force only.

The invention is not restricted to the embodiment described above and illustrated in the drawings, but may be modified in several ways within the scope of the appended claims.

What I claim and desire to secure by Letters Patent is:

1. An elongate core for providing passages (12) in a body (13) of castable material, which is to be cast in an outer mould (11), comprising:

an elongate core provided with anchoring means (4,6) at opposing ends of said core;

at least one tensioning member (10) extending between said anchoring means for prestressing the core (1) prior to casting; and means for disengaging the core (1) from a finished body cast from said material and for relieving the prestress against said body (13) or the outer mould (11), said core disengaging and prestress relieving means including an abutment (8) movable longitudinally relative to said core and engageable with said body or the outer mould.

2. A core as claimed in claim 1, wherein said anchoring means (4,6) are stationary relative to said core, and said abutment (8) is positively connected to said anchoring means (6) at one end (5) of said core (1), and said abutment (8), engages said one end (5) of said core prior to casting;

at least one spacer (14) for placement between said abutment and an end of said finished body; and said means for disengaging said core (1) from a finished body (13), further includes means for moving said abutment outwardly from said one end of said core and, after application of at least one spacer (14) between said abutment and said end of said finished body, for moving said abutment inwardly towards said one end (5) of said core until it engages said end of said finished body or said outer mould (11), whereby said prestress is relieved.

3. A core as claimed in claim 1 or 2, wherein aid positive connection between said anchoring means (6) at said one end (5) of said core (1) and said abutment (8) is in the form of a jack unit (9) comprising at least one jack.

4. A core as in claim 3 wherein said core is hollow; and said anchoring means (4,6), said tensioning members (10) and said jack unit (9) are positioned within said core (1), said abutment (8) being positioned outside said core.

* * * * *